US010220294B1

(12) United States Patent
Pierre-Louis

(10) Patent No.: US 10,220,294 B1
(45) Date of Patent: Mar. 5, 2019

(54) MODULAR SKATING ASSEMBLY

(71) Applicant: Charlene Pierre-Louis, Freeport, NY (US)

(72) Inventor: Charlene Pierre-Louis, Freeport, NY (US)

( * ) Notice: Subject to any disclaimer, the term of this patent is extended or adjusted under 35 U.S.C. 154(b) by 0 days.

(21) Appl. No.: 15/921,466

(22) Filed: Mar. 14, 2018

(51) Int. Cl.

| | |
|---|---|
| ***A63C 17/02*** | (2006.01) |
| ***A63C 17/06*** | (2006.01) |
| ***A63C 17/22*** | (2006.01) |
| ***A43B 5/16*** | (2006.01) |
| *A63C 17/00* | (2006.01) |

(52) U.S. Cl.
CPC ..... *A63C 17/226* (2013.01); *A43B 5/1633* (2013.01); *A43B 5/1641* (2013.01); *A63C 17/02* (2013.01); *A63C 17/068* (2013.01); *A63C 2017/0053* (2013.01)

(58) Field of Classification Search
CPC ..... A63C 17/226; A63C 17/02; A63C 17/04; A63C 17/068; A63C 17/06; A63C 2017/0053; A43B 5/1633; A43B 5/1641; A43B 5/1658
USPC ..... 280/11.223, 8
See application file for complete search history.

(56) References Cited

U.S. PATENT DOCUMENTS 2,868,553 A * 1/1959 Rieckman ..... A63C 17/18 280/11.27
3,918,729 A * 11/1975 Peters ..... A63C 17/18 280/11.3
4,008,901 A * 2/1977 Conn ..... A63C 17/18 280/11.3
4,657,265 A * 4/1987 Ruth ..... A63C 17/18 280/11.27
5,193,827 A 3/1993 Olson
5,314,199 A * 5/1994 Olson ..... A63C 17/0086 280/11.231
5,421,596 A 6/1995 Lee
5,494,304 A 2/1996 Levy et al.
5,507,506 A * 4/1996 Shadroui ..... A43B 5/1633 280/11.224
5,961,129 A * 10/1999 Post ..... A63C 17/18 280/11.27
6,145,852 A * 11/2000 Bain ..... A43B 5/1633 280/11.221
6,213,479 B1 4/2001 Cochimin
6,322,088 B1 11/2001 Klamer et al.
6,955,361 B2 * 10/2005 Borel ..... A43B 5/0403 280/11.231

(Continued)

FOREIGN PATENT DOCUMENTS

WO WO9420176 9/1994

*Primary Examiner* — John D Walters

(57) ABSTRACT

A modular skating assembly for switching between types of skating styles includes a boot that is configured to couple to a foot of a user. A first coupler is coupled to a sole of the boot. Each of a plurality of second couplers is complementary to the first coupler. Each of a plurality of skate modules is coupled to a respective second coupler. The respective second coupler is positioned to couple to the first coupler to selectively couple the skate module to the boot. The improvement is the plurality of skate modules being selectively couplable to the boot, such that a pair of the boots is selectively configurable to enable a particular style of skating, such as in-line skating and roller skating.

10 Claims, 6 Drawing Sheets

(56) References Cited

U.S. PATENT DOCUMENTS 8,544,855 B2 * 10/2013 Shepley ..... A63C 1/16
280/11.221

* cited by examiner

MODULAR SKATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to skating assemblies and more particularly pertains to a new skating assembly for switching between types of skating styles.

BRIEF SUMMARY OF THE INVENTION

An embodiment of the disclosure meets the needs presented above by generally comprising a boot that is configured to couple to a foot of a user. A first coupler is coupled to a sole of the boot. Each of a plurality of second couplers is complementary to the first coupler. Each of a plurality of skate modules is coupled to a respective second coupler. The respective second coupler is positioned to couple to the first coupler to selectively couple the skate module to the boot. The improvement is the plurality of skate modules being selectively couplable to the boot, such that a pair of the boots is selectively configurable to enable a particular style of skating, such as in-line skating and roller skating.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
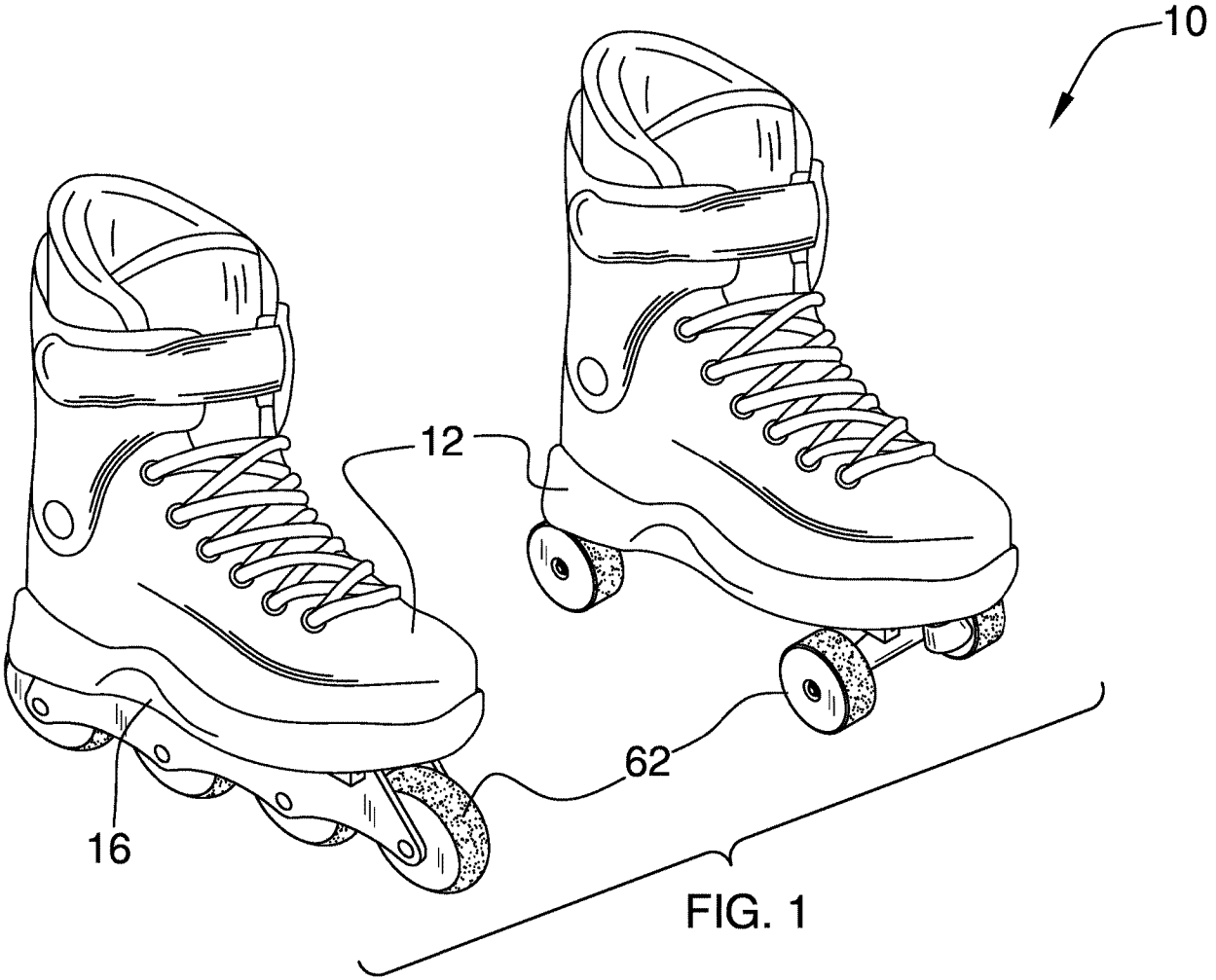
FIG. 1 is an isometric perspective view of a modular skating assembly according to an embodiment of the disclosure.
Figure 2:
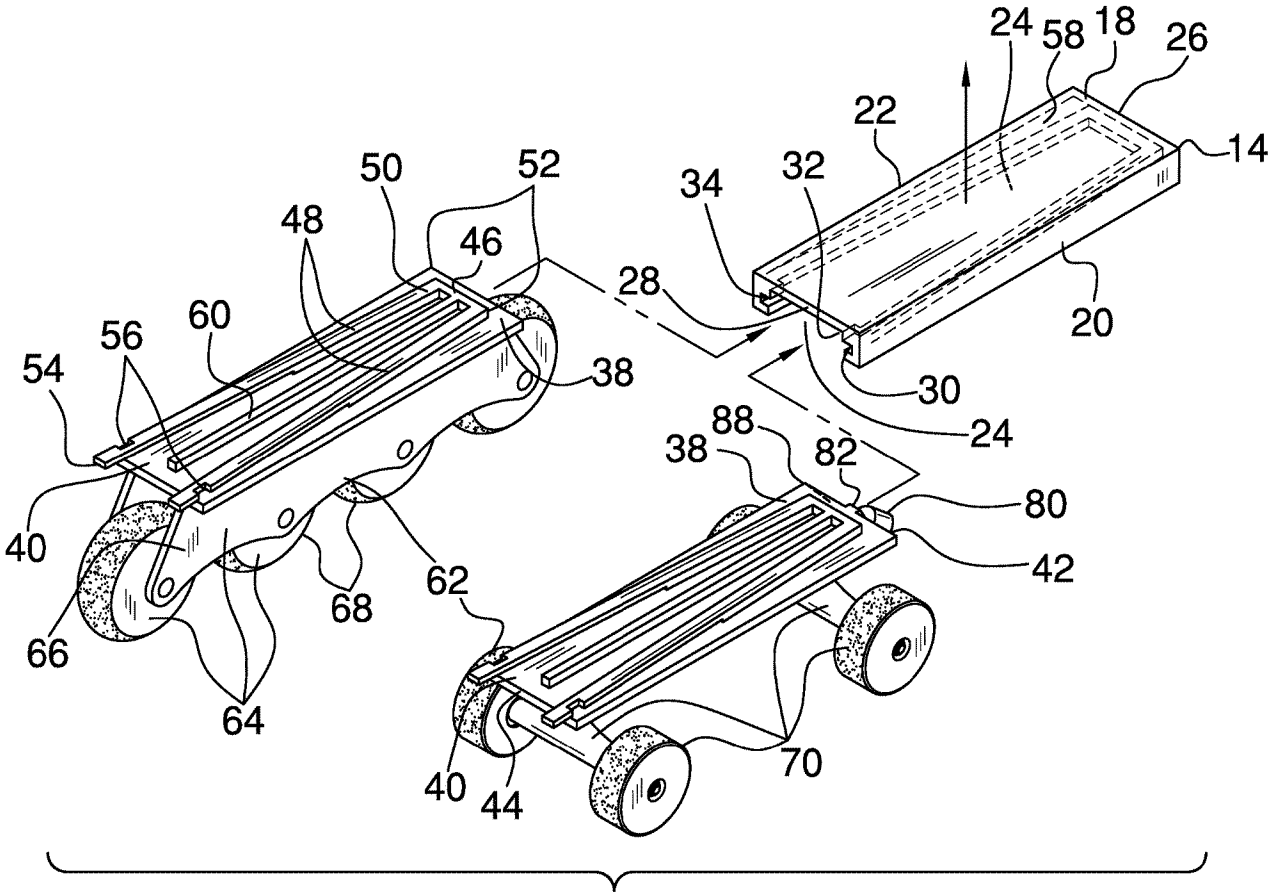
FIG. 2 is an isometric perspective view of an embodiment of the disclosure.
Figure 3:
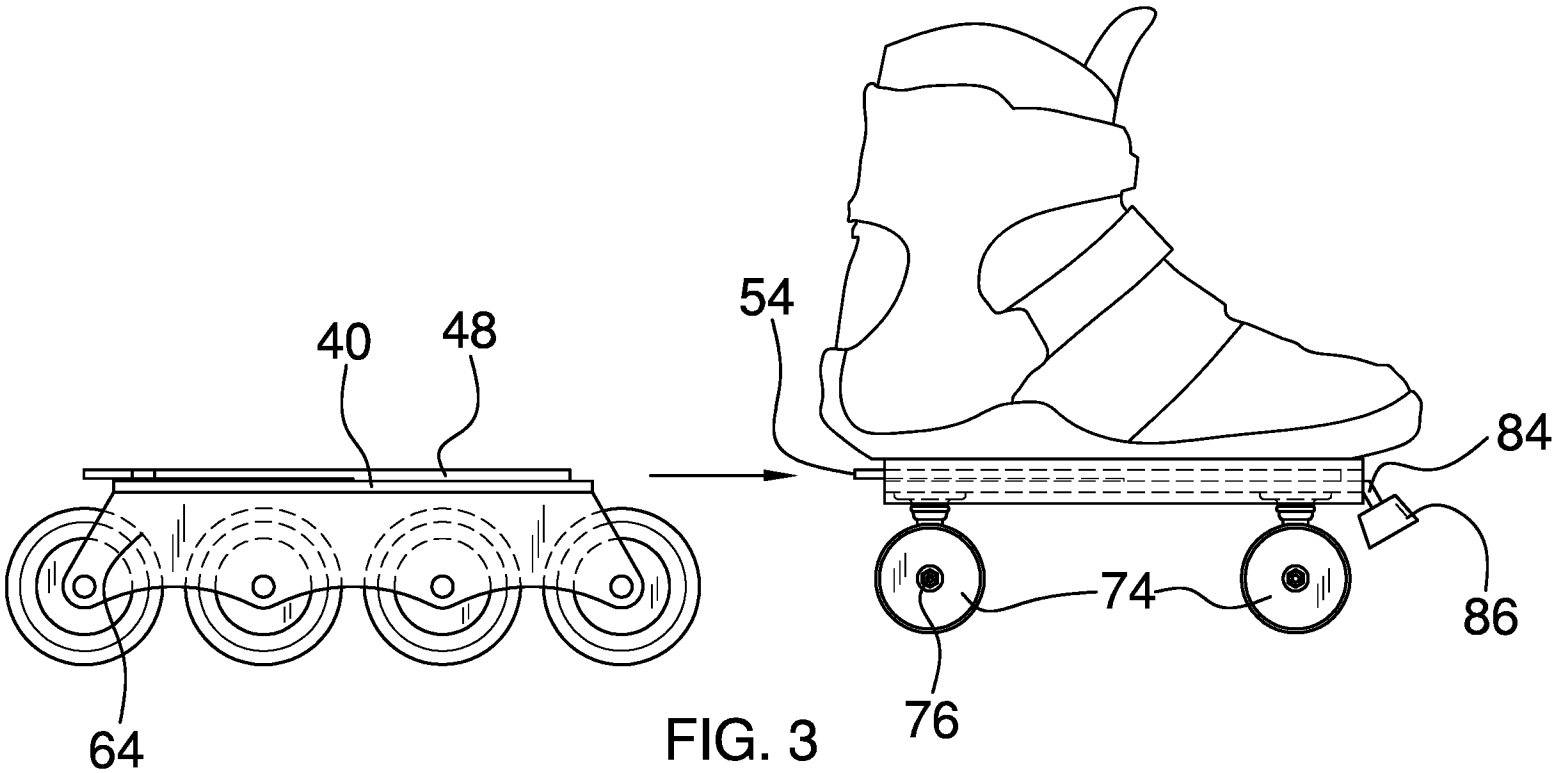
FIG. 3 is a side view of an embodiment of the disclosure.
Figure 4:
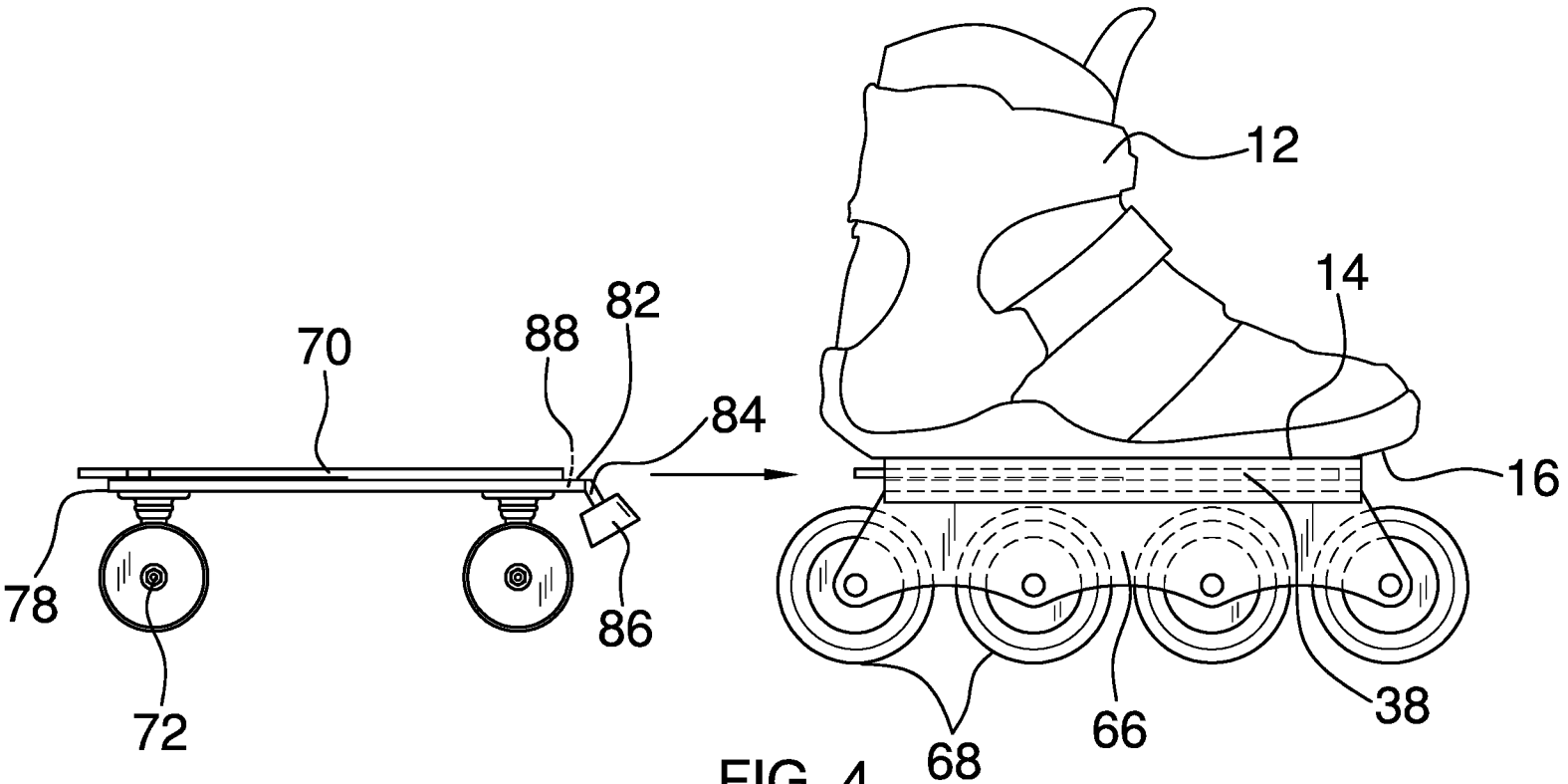
FIG. 4 is a side view of an embodiment of the disclosure.
Figure 5:
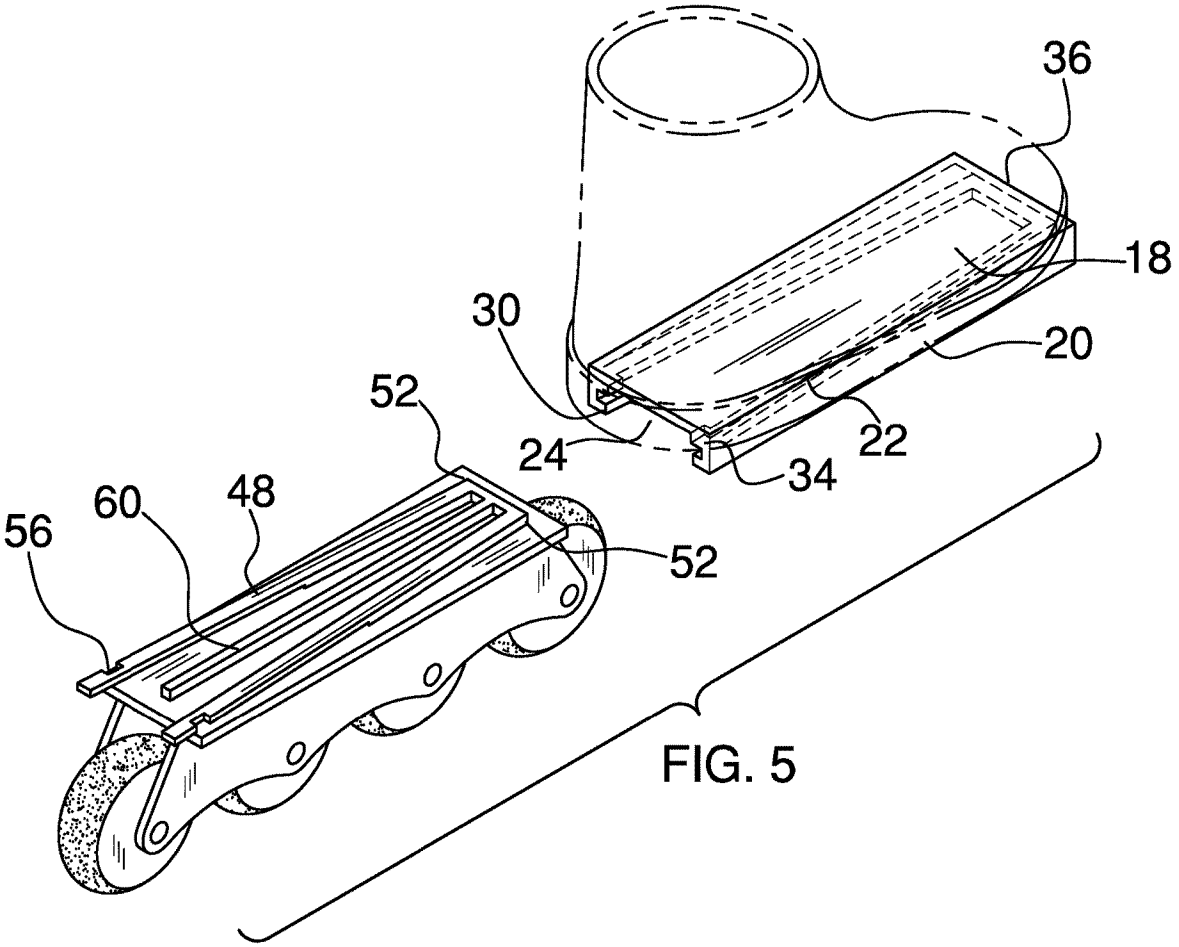
FIG. 5 is an isometric perspective view of an embodiment of the disclosure.
Figure 6:
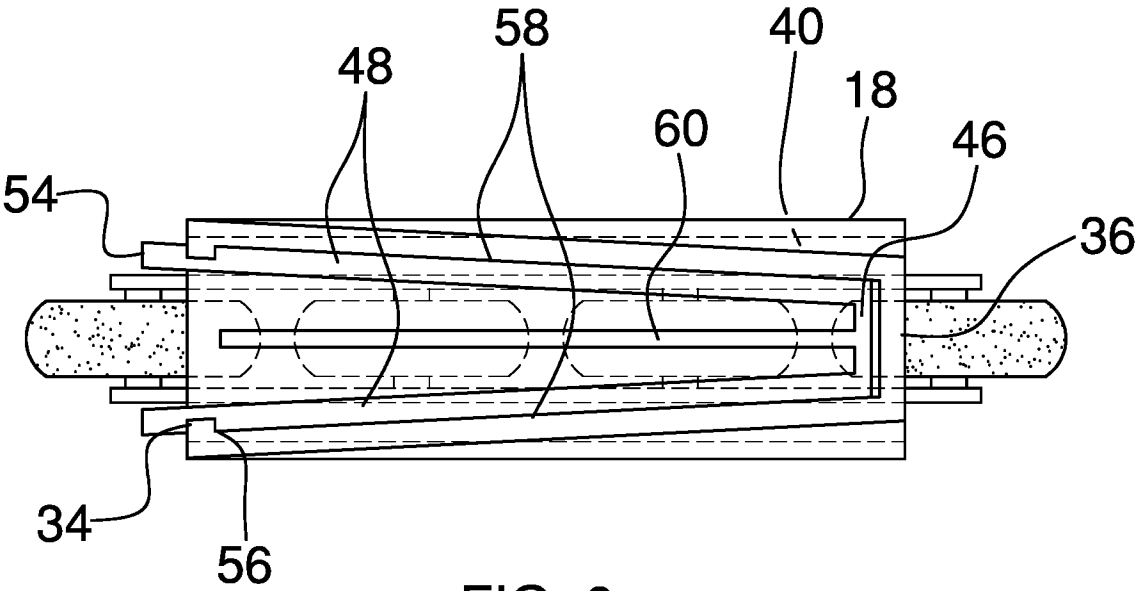
FIG. 6 is a top view of an embodiment of the disclosure.

With reference now to the drawings, and in particular to FIGS. 1 through 6 thereof, a new skating assembly embodying the principles and concepts of an embodiment of the disclosure and generally designated by the reference numeral 10 will be described.

As best illustrated in FIGS. 1 through 6, the modular skating assembly 10 generally comprises a boot 12 that is configured to couple to a foot of a user. A first coupler 14 is coupled to a sole 16 of the boot 12. In one embodiment, the first coupler 14 comprises a first plate 18 that is coupled to the sole 16. Each of a pair of first bars 20 is coupled to and extends from the first plate 18. Each first bar 20 is positioned longitudinally along a respective opposing edge 22 of the first plate 18. The first bars 20 define an inset 24. The first bars 20 are dimensionally wider proximate to a front 26 of the first plate 18 so that the inset 24 is dimensionally wider proximate to a rear 28 of the first plate 18.

Each of a pair of channels 30 is positioned longitudinally in an inside face 32 of a respective first bar 20. The channels 30 extend from proximate to the front 26 to the rear 28 of the first plate 18. Each of a pair of tabs 34 is coupled to a respective first bar 20 and the first plate 18 adjacent to the rear 28 of the first plate 18. In another embodiment, a second bar 36 is coupled to and extends between the first bars 20. The second bar 36 is coupled to the first plate 18 adjacent to the front 26 of the first plate 18.

Each of a plurality of second couplers 38 is complementary to the first coupler 14. In one embodiment, each second coupler 38 comprises a second plate 40 that is insertable into the pair of channels 30 such that a first edge 42 of the second plate 40 is positioned proximate to the front 26 of the first plate 18 and a second edge 44 of the second plate 40 is positioned adjacent to the rear 28 of the first plate 18. In another embodiment, the second plate 40 is rectangularly shaped.

A first rod 46 is coupled to the second plate 40 proximate to and parallel to the first edge 42. Each of a pair of second rods 48 has a first endpoint 50. The first endpoint 50 is coupled to a respective opposing end 52 of the first rod 46. Each second rod 48 extends transversely from the first rod 46 such that a second endpoint 54 of the second rod 48 is positioned past the second edge 44 of the second plate 40.

The second rods 48 are resilient. The second rods 48 are selectively bendable to position the second rods 48 between the tabs 34 as the second plate 40 is positioned in the pair of channels 30.

Each of a pair of cutouts 56 is positioned in a respective second rod 48 proximate the second endpoint 54. The cutouts 56 are complementary to the tabs 34. The cutouts 56 are positioned to insert the tabs 34 to couple the second plate 40 to the first plate 18 and position the second rods 48 adjacent to a rim 58 of the inset 24.

In another embodiment, a third rod 60 is coupled to and extends perpendicularly from the first rod 46. The third rod 60 is positioned equally distant from the opposing ends 52 of the first rod 46.

Each of a plurality of skate modules 62 is coupled to a respective second coupler 38. The respective second coupler 38 is positioned to couple to the first coupler 14 to selectively couple the skate module 62 to the boot 12.

In one embodiment, the plurality of skate modules 62 comprises an in-line skate setup 64. The in-line skate setup 64 comprises a pair of third plates 66 and a plurality of first wheels 68. The third plates 66 are coupled to and extend perpendicularly from the second plate 40 of a respective second coupler 38. The third plates 66 extend from proximate to the first edge 42 to proximate to the second edge 44 of the second plate 40. Each first wheel 68 is positioned between and axially couple to each of the pair of third plates 66. The first wheels 68 are linearly positioned beneath the second plate 40. In another embodiment, the plurality of first wheels 68 comprises four first wheels 68.

In yet another embodiment, the plurality of skate modules 62 comprises a roller skating setup 70. The roller skating setup 70 comprises a pair of axles 72 and a set of four second wheels 74. The pair of axles 72 is coupled singly proximate to the first edge 42 and the second edge 44 of a respective second plate 40. Each second wheel 74 is rotationally coupled to a respective opposing endpoint 76 of the axle 72. Each of the set of four second wheels 74 is positioned proximate to an associated corner 78 of the second plate 40 when the second coupler 38 is coupled to the first coupler 14.

In one embodiment, a stopper 80 is coupled to and extends from the first edge 42 of the second plate 40. The stopper 80 is configured to selectively contact a surface upon which the user is rolling. The user is positioned to slow and stop. In another embodiment, the stopper 80 comprises a first shaft 82, a second shaft 84 and a bulb 86. The first shaft 82 is coupled to and extends from the first edge 42 of the second plate 40. The first shaft 82 is substantially centrally positioned on the first edge 42. The first shaft 82 is complementary to a slot 88 that is positioned through the second bar 36. The first shaft 82 is insertable through the slot 88 as the second plate 40 is inserted into the channels 30. The second shaft 84 is coupled to and extends transversely from the first shaft 82 distal from the second plate 40. The bulb 86 is coupled to the second shaft 84 distal from the first shaft 82 so that the bulb 86 is configured to selectively contact the surface upon which the user is rolling.

In use, the second rods 48 are selectively bendable to position the second rods 48 between the tabs 34 as the second plate 40 is positioned in the pair of channels 30. The cutouts 56 are positioned to insert the tabs 34 to couple the second plate 40 to the first plate 18 and to position the second rods 48 adjacent to the rim 58 of the inset 24. The plurality of skate modules 62 is selectively couplable to the boot 12. The pair of the boots 12 is selectively configurable to the particular style of skating, such as in-line skating and roller skating.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular skating assembly comprising:

a boot configured for coupling to a foot of a user;

a first coupler coupled to a sole of said boot;

a plurality of second couplers, each said second coupler being complementary to said first coupler;

a plurality of skate modules, each said skate module being coupled to a respective said second coupler, wherein said respective said second coupler is positioned on said skate module such that said respective said second coupler is positioned to couple to said first coupler to selectively couple said skate module to said boot;

wherein said plurality of skate modules is selectively couplable to said boot, such that a pair of said boots is selectively configurable for a particular style of skating;

said first coupler comprising:

a first plate coupled to said sole, a pair of first bars coupled to and extending from said first plate, each said first bar being positioned longitudinally along a respective opposing edge of said first plate defining an inset, said first bars being dimensionally wider proximate to a front of said first plate such that said inset is dimensionally wider proximate to a rear of said first plate, a pair of channels, each said channel being positioned longitudinally in an inside face of respective said first bar, said channels extending from proximate to said front to said rear of said first plate, and a pair of tabs, each said tab being coupled to a respective said first bar and said first plate adjacent to said rear of said first plate;

each said second coupler comprising:

a second plate, said second plate being insertable into said pair of channels such that a first edge of said second plate is positioned proximate to said front of said first plate and a second edge of said second plate is positioned adjacent to said rear of said first plate, a first rod coupled to said second plate proximate to and parallel to said first edge, a pair of second rods, each said second rod having a first endpoint, said first endpoint being coupled to a respective opposing end of said first rod, each said second rod extending transversely from said first rod such that a second endpoint of said second rod is positioned past said second edge of said second plate, said second rods being resilient such that said second rods are selectively bendable for positioning said second rods between said tabs as said second plate is positioned in said pair of channels, and a pair of cutouts, each said cutout being positioned in a respective said second rod proximate said second endpoint, said cutouts being complementary to said tabs; and wherein said cutouts are positioned in said second rods such that said cutouts are positioned for inserting said tabs to couple said second plate to said first plate and positioning said second rods adjacent to a rim of said inset.

2. The assembly of claim 1, further including a second bar coupled to and extending between said first bars, said second bar being coupled to said first plate adjacent to said front of said first plate.

3. The assembly of claim 1, further including said second plate being rectangularly shaped.

4. The assembly of claim 1, further a third rod coupled to and extending perpendicularly from said first rod, said third rod being positioned equally distant from said opposing ends of said first rod.

5. The assembly of claim 1, further including said plurality of skate modules comprising an in-line skate setup, said in-line skate setup comprising a pair of third plates and a plurality of first wheels, said third plates being coupled to and extending perpendicularly from said second plate of a respective said second coupler, said third plates extending from proximate to said first edge to proximate to said second edge of said second plate, each said first wheel being positioned between and axially couple to each of said pair of third plates such that said first wheels are linearly positioned beneath said second plate.

6. The assembly of claim 5, further including said plurality of first wheels comprising four said first wheels.

7. The assembly of claim 1, further including said plurality of skate modules including a roller skating setup, said roller skating setup comprising a pair of axles and a set of four second wheels, said pair of axles being coupled singly proximate to said first edge and said second edge of a respective said second plate, each said second wheel being rotationally coupled to a respective opposing endpoint of said axle such that each of said set of four second wheels is positioned proximate to an associated corner of said second plate when said second coupler is coupled to said first coupler.

8. The assembly of claim 7, further including a stopper coupled to and extending from said first edge of said second plate, wherein said stopper is positioned on said second plate such that said stopper is configured for selectively contacting a surface upon which the user is rolling, such that the user is positioned to slow and stop.

9. A modular skating assembly comprising:

a boot configured for coupling to a foot of a user;

a first coupler coupled to a sole of said boot;

a plurality of second couplers, each said second coupler being complementary to said first coupler;

a plurality of skate modules, each said skate module being coupled to a respective said second coupler, wherein said respective said second coupler is positioned on said skate module such that said respective said second coupler is positioned to couple to said first coupler to selectively couple said skate module to said boot; and wherein said plurality of skate modules is selectively couplable to said boot, such that a pair of said boots is selectively configurable for a particular style of skating;

said plurality of skate modules including a roller skating setup, said roller skating setup comprising a pair of axles and a set of four second wheels, said pair of axles being coupled singly proximate to said first edge and said second edge of a respective said second plate, each said second wheel being rotationally coupled to a respective opposing endpoint of said axle such that each of said set of four second wheels is positioned proximate to an associated corner of said second plate when said second coupler is coupled to said first coupler;

a stopper coupled to and extending from said first edge of said second plate, wherein said stopper is positioned on said second plate such that said stopper is configured for selectively contacting a surface upon which the user is rolling, such that the user is positioned to slow and stop; and said stopper comprising a first shaft, a second shaft and a bulb, said first shaft being coupled to and extending from said first edge of said second plate, said first shaft being substantially centrally positioned on said first edge, said first shaft being complementary to a slot positioned through said second bar such that said first shaft is insertable through said slot as said second plate is inserted into said channels, said second shaft being coupled to and extending transversely from said first shaft distal from said second plate, said bulb being coupled to said second shaft distal from said first shaft positioning said bulb for selectively contacting the surface upon which the user is rolling.

10. A modular skating assembly comprising:

a boot configured for coupling to a foot of a user;

a first coupler coupled to a sole of said boot, said first coupler comprising:

a first plate coupled to said sole, a pair of first bars coupled to and extending from said first plate, each said first bar being positioned longitudinally along a respective opposing edge of said first plate defining an inset, said first bars being dimensionally wider proximate to a front of said first plate such that said inset is dimensionally wider proximate to a rear of said first plate, a pair of channels, each said channel being positioned longitudinally in an inside face of respective said first bar, said channels extending from proximate to said front to said rear of said first plate, a pair of tabs, each said tab being coupled to a respective said first bar and said first plate adjacent to said rear of said first plate, and a second bar coupled to and extending between said first bars, said second bar being coupled to said first plate adjacent to said front of said first plate;

a plurality of second couplers, each said second coupler being complementary to said first coupler, each said second coupler comprising:

a second plate, said second plate being insertable into said pair of channels such that a first edge of said second plate is positioned proximate to said front of said first plate and a second edge of said second plate is positioned adjacent to said rear of said first plate, said second plate being rectangularly shaped, a first rod coupled to said second plate proximate to and parallel to said first edge, a pair of second rods, each said second rod having a first endpoint, said first endpoint being coupled to a respective opposing end of said first rod, each said second rod extending transversely from said first rod such that a second endpoint of said second rod is positioned past said second edge of said second plate, said second rods being resilient such that said second rods are selectively bendable for positioning said second rods between said tabs as said second plate is positioned in said pair of channels, a pair of cutouts, each said cutout being positioned in a respective said second rod proximate said second endpoint, said cutouts being complementary to said tabs, wherein said cutouts are positioned in said second rods such that said cutouts are positioned for inserting said tabs to couple said second plate to said first plate and positioning said second rods adjacent to a rim of said inset, and a third rod coupled to and extending perpendicularly from said first rod, said third rod being positioned equally distant from said opposing ends of said first rod;

a plurality of skate modules, each said skate module being coupled to a respective said second coupler, wherein said respective said second coupler is positioned on said skate module such that said respective said second coupler is positioned to couple to said first coupler to selectively couple said skate module to said boot, said plurality of skate modules comprising:

an in-line skate setup, said in-line skate setup comprising a pair of third plates and a plurality of first wheels, said third plates being coupled to and extending perpendicularly from said second plate of a respective said second coupler, said third plates extending from proximate to said first edge to proximate to said second edge of said second plate, each said first wheel being positioned between and axially couple to each of said pair of third plates such that said first wheels are linearly positioned beneath said second plate, said plurality of first wheels comprising four said first wheels, and a roller skating setup, said roller skating setup comprising a pair of axles and a set of four second wheels, said pair of axles being coupled singly proximate to said first edge and said second edge of a respective said second plate, each said second wheel being rotationally coupled to a respective opposing endpoint of said axle such that each of said set of four second wheels is positioned proximate to an associated corner of said second plate when said second coupler is coupled to said first coupler, and a stopper coupled to and extending from said first edge of said second plate, wherein said stopper is positioned on said second plate such that said stopper is configured for selectively contacting a surface upon which the user is rolling, such that the user is positioned to slow and stop, said stopper comprising a first shaft, a second shaft and a bulb, said first shaft being coupled to and extending from said first edge of said second plate, said first shaft being substantially centrally positioned on said first edge, said first shaft being complementary to a slot positioned through said second bar such that said first shaft is insertable through said slot as said second plate is inserted into said channels, said second shaft being coupled to and extending transversely from said first shaft distal from said second plate, said bulb being coupled to said second shaft distal from said first shaft positioning said bulb for selectively contacting the surface upon which the user is rolling; and wherein said second rods are resilient such that said second rods are selectively bendable for positioning said second rods between said tabs as said second plate is positioned in said pair of channels, wherein said cutouts are positioned in said second rods such that said cutouts are positioned for inserting said tabs to couple said second plate to said first plate and positioning said second rods adjacent to said rim of said inset, such that said plurality of skate modules is selectively couplable to said boot, such that said pair of said boots is selectively configurable for the particular style of skating.

* * * * *